United States Patent [19]

Robbins

[11] 3,987,962

[45] Oct. 26, 1976

[54] MULTI POSITION RAIL FASTENINGS

[75] Inventor: Montague Albert Robbins, Backwell, England

[73] Assignee: Resilient Grip Limited, Bristol, England

[22] Filed: June 23, 1975

[21] Appl. No.: 589,550

[30] Foreign Application Priority Data

July 13, 1974 United Kingdom ..... 31114/74

[52] U.S. Cl. ..... 238/287; 238/340

[51] Int. Cl.[2] ..... E01B 9/46

[58] Field of Search ..... 238/282, 338, 287, 283, 238/310–315, 349, 339–341; 85/50 R, 23, 24, 25

[56] References Cited

UNITED STATES PATENTS

| | | | |
|---|---|---|---|
| 1,130,797 | 3/1915 | Cornell | 85/50 R |
| 1,148,491 | 7/1915 | Hall | 85/50 R |
| 1,836,713 | 12/1931 | Hewitt | 85/50 R |
| 2,168,324 | 8/1939 | Case | 238/341 |
| 3,457,825 | 7/1969 | Caty | 85/50 R |
| 3,758,032 | 9/1973 | Varga | 238/338 |

*Primary Examiner*—Robert J. Spar
*Assistant Examiner*—James M. Slattery
*Attorney, Agent, or Firm*—Shoemaker and Mattare, Ltd.

[57] ABSTRACT

The invention relates to a rail fastening arrangement for securing a flat bottom rail on a foundation having preformed holes therein.

There is provided a base plate on which the flat bottom of the rail rests and anchors for securing the base plate to the preformed holes in the foundation. A pair of rail clips is provided one on each side of the rail with bolts passing through a bolt aperture in each clip and engaging in a preformed bolt hole in the base plate. Each clip has symmetrically spaced about its bolt aperture at least one pair of recesses and the base plate has symmetrically spaced about each of its bolt holes an upstanding pin is received and located in a recess of one of the clips. Each clip is engageable with the base plate with one of its recesses receiving an upstanding pin of the base plate in at least two alternative dispositions. Each clip has for each recess a respective rail foot abutting and clamping shoulder, one of which rail foot abutting and clamping shoulders faces inwardly towards the rail foot for each alternative disposition of engagement of the clip with the base plate and for each clip, each respective rail foot abutting and clamping shoulder is differentially spaced from the center of the bolt aperture of the clip.

14 Claims, 2 Drawing Figures

MULTI POSITION RAIL FASTENINGS

Figure 1:
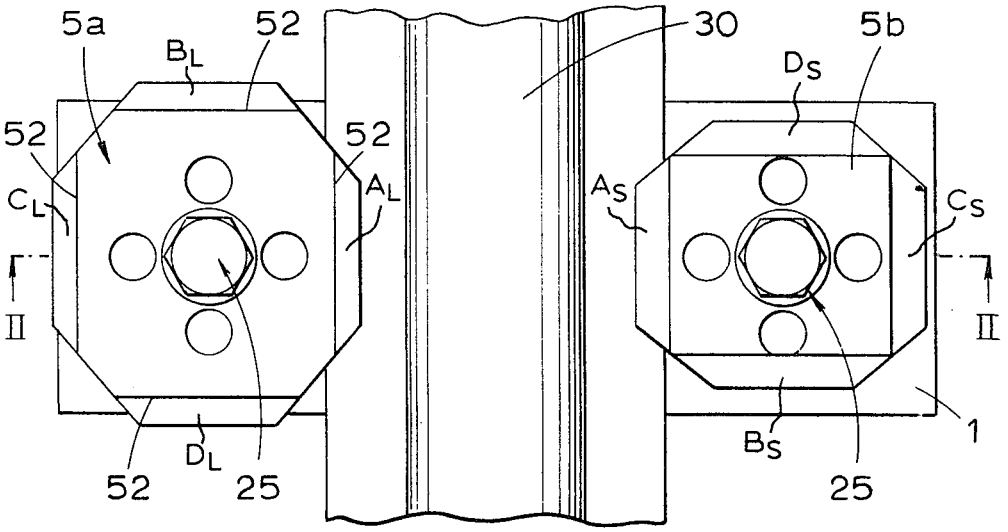

This invention relates to rail fastenings for securing flat bottom rails to a concrete or wooden foundation which may be a sleeper, largely of the type described in British Patent Specification No. 1,336,999 or U.S. Pat. No. 3,758,032. It is aimed at the same objects as the above specifications, but offers an improved and simplified design of rail clip and base plate to achieve these objects.

In fact in the above specifications, a flat base plate is used with multiple perforations to allow multiple lugs formed on rail clips to enter for purposes of location, as well as for one lug opposite the rail foot to take lateral thrust due to the rail loading. In the various embodiments shown in the above specifications, a central bolt passes through the clips to secure the clip and develop the grip between the rail foot and the base plate.

Two difficulties have been experienced with this design in production:

1. The manufacture of the clips with multiple projecting lugs has proved to be difficult and expensive having regard to the required close tolerances.

2. The production of the base plate in an economical fashion wherein all the perforations are formed simultaneously was difficult in that the piercing operation required such heavy presses as to be in general beyond the scope of many which are available.

The present invention has for its object to overcome these difficulties while allowing lateral adjustment to the rail in relation to the base plate in fine steps.

Broadly stated according to the present invention, the clips are not formed with projecting lugs, but instead, at least two recesses are formed on at least one side of each rail clip in a manner which renders the clips particularly convenient for forging manufacture, while two single pins are set into the base plate to upstand therefrom, one each on opposite sides of the rail foot.

The position of these pins is on the side of the bolt fixing holes remote from the rail foot, so placed that a line passing through the centres of the pin and fixing bolt holes will be at right angles to the rail.

This pin is preferably formed with domed or part-spherical head which can engage in one of the recesses formed in the clips, which are preferably correspondingly part spherical. In fact, for each position of the clip, one of the recesses will come to receive the head of the pin and this will act as a reaction support for both the clamping force developed on the clips by the bolt fixings, as well as the lateral load due to side loads developed on the rail head.

According to the arrangements of the clips, which are upper and lower sided, there may be a total of four, six, eight or ten depressions in each clip and there are correspondingly four, six, eight or ten positions for each clip, with one depression in turn engaging the reaction pin.

The reaction pin can be secured in the base plate in a variety of ways. It can be riveted or welded in, or it can be fitted with a controlled taper which may also be glued by means of modern resin gluing techniques.

This arrangement simplifies the design of the base plate, and the number of holes which have to be pierced in each is greatly reduced. The reaction pins are simple and robust, and their height of protrusion from the surface of the base plate is not great, generally not more than ½ inch. Thus the base plate remains a simple element not vulnerable to damage and the clips may be manufactured as steel forgings in a simple manner in which their accuracy and strength and shock resistance are all safeguarded.

Figure 2:
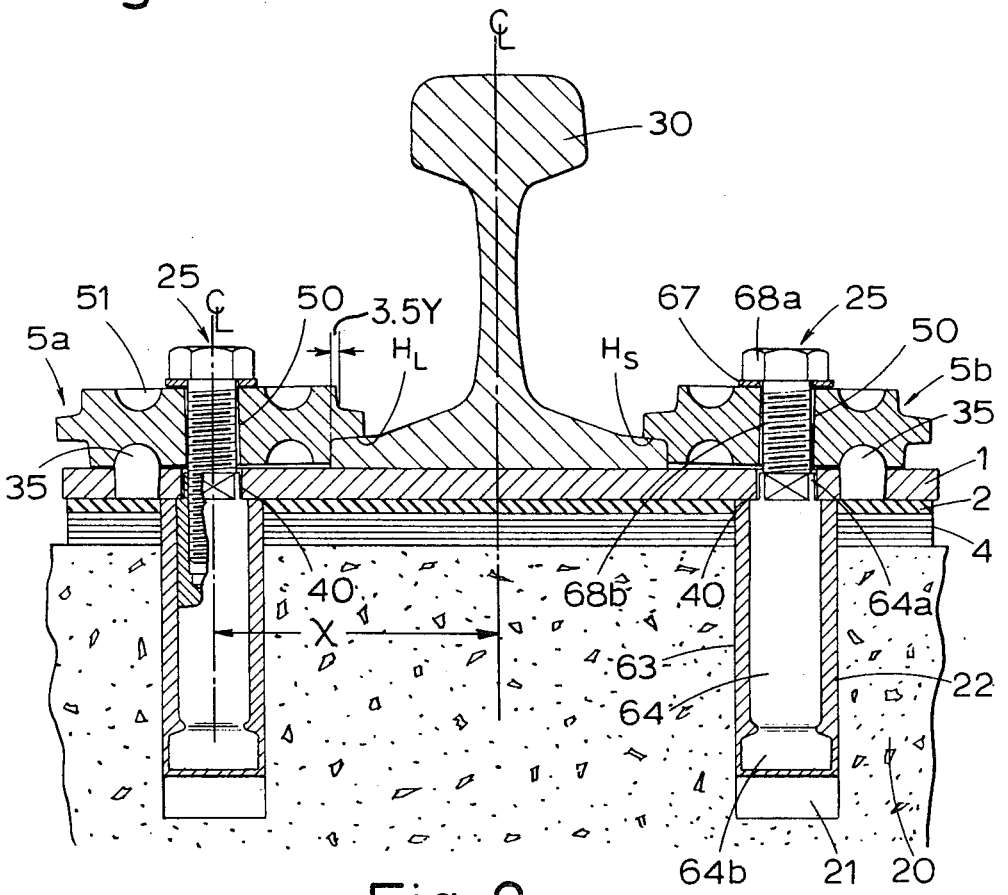

One embodiment of the invention will be described by way of example with reference to the accompanying drawing in which:

FIG. 1 is a plan view of a rail fastening arrangement according to the invention; while FIG. 2 is a transverse cross-sectional view taken on the line II—II of FIG. 1.

Referring to the drawings, 30 represents a flat bottom rail resting on a steel base plate 1. The base plate 1 in turn rests on a resilient pad 2 which in turn rests upon a foundation 20 with intervening packing 4 to a thickness which may be adjusted according to requirements. The packing 4 may consist of asbestos sheets. The foundation 20 may be timber or concrete or it may comprise a concrete or wooden sleeper. The foundation 20 has preformed therein two holes 21.

The base plate 1 has upstanding therefrom two pins 35 equally spaced from two apertures or through holes 40 in the base plate, the apertures 40 aligning with the preformed holes 21 in the foundation 20. The resilient pad 2 and the packing 4 have through apertures in alignment with the apertures 40 and preformed holes 21.

5*a* and 5*b* represent a pair of clips, one on each side of the rail 30. Each clip has an aperture 50 through which passes a bolt anchorage device generally designated 25. The bolt anchorage devices 25 will now be described in some detail.

Tightening down the anchorages 25 as hereafter described, secures the rail 30 to the foundation 20, in selected alternative locations relative to the preformed holes 21.

Each bolt anchorage device 25 comprises a bolt element having a shank portion 68*b* which is threaded, and a head 68*a*. The threaded shank portion 68*b* passes through an aperture 50 in one of the rail clips 5*a* or 5*b*. 67 represents a washer interposed between each bolt head 68*a* and a rail clip 5*a* or 5*b*.

The threaded shank portion 68*b* is in threaded engagement with an elongate nut element 64 encased in a sleeve 63 of elastomeric material. The lower end 64*b* of the nut element 64 is enlarged and corrugated and is also enclosed in the sleeve 63. The upper end 64*a* of the nut element 64 protrudes from the sleeve 63 and is of reduced size compared with the remainder of the nut element 64. Moreover, the upper end portion 64*a* has a non-circular exterior engaged in the hole 40 of the base plate which is correspondingly shaped. For example, the upper end portion 64*a* and the base plate 40 may be of rectangular shape so that when interengaged, the nut 64 cannot rotate relative to the base plate although it can move vertically relative to the base plate over a limited distance.

Tightening down of bolt head 68*a* firstly causes upward movement of nut 64 to effect deformation of the resilient sleeve 63 into engagement with the walls of the foundation holes 21, with the non-circular upper part 64*a* of the nut 64 becoming engaged in the noncircular hole 40 of the base plate until a shoulder on the nut 64 engages with the base plate, whereafter further deformation of the resilient sleeve 63 is prevented. Thereafter, tightening of the bolt 68 causes its head 68*a* to approach the base plate 1 thereby tightening the clip 5*a* or 5*b* down onto the base plate.

By the bolt anchorage means above described the same bolt means 25 are employed to secure the clips 5*a* or 5*b* to the base plate 1 and simultaneously to secure the base plate 1 to the foundation 20 including the intervening resilient pad 2 and the packing 4.

Each rail clip 5*a* or 5*b* has symmetrically spaced about its bolt aperture 50 at least two recesses.

However, in the embodiment shown, the clips 5*a* and 5*b* are each two-sided, that is, they have upper and lower sides and each clip has four recesses on its upper side and four recesses on its lower side. Alternatively, the clip could have two, three, five or more recesses on each of its upper and lower sides.

All the recesses 51 are equally spaced from the aperture 50 of each respective clip 5*a* or 5*b*.

As illustrated, the recesses are spherically re-entrant to receive the pins 35, upstanding from the base plate 1, whose heads are correspondingly spherically domed.

The pins 35 are affixed in preformed holes in the base plate 1 by riveting, welding, adhesive bonding or by press or taper fitting to upstand from the base plate.

According to a characteristic feature of the invention, each clip 5*a* or 5*b* has for each of its spherical recesses 51 a rail foot abutting and clamping shoulder. Thus for the four recesses on the upper side of the rail clip 5*a* there are four rail foot abutting and clamping shoulders 52. Moreover, on the opposite side of the clip 5*a*, where there are four further recesses 51, there are also four further rail foot abutting and clamping shoulders 52. All the said eight rail foot abutting and clamping shoulders 52 of the clip 5*a* are differently spaced from the clip aperture 50.

In a similar manner, the clip 5*b* also has a total of eight rail foot abutting and clamping shoulders 52 differently spaced from the clip aperture 50. Thus, considering the two clips 5*a* and 5*b* there may be provided a total of sixteen rail foot abutting and clamping shoulders 52, all differently spaced from the apertures 50 of the rail clips 5*a* or 5*b*. However, in the embodiment shown and as illustrated in FIG. 2, the pair of rail foot abutting and clamping shoulders 52 actually shown engaged with the rail foot are equally spaced from the apertures 50 of the respective clips 5*a* and 5*b*.

Preferably the spacing of the various shoulders 52 from the clip apertures 50 is so arranged that when say the clip 5*a* is disposed in a given disposition, that is to say, when its shoulder identified as $H_L$ in the drawing is engaged with the rail foot, then the clip 5*b* can be so disposed by rotation or inversion whereby it has a shoulder identified on the drawing as $H_S$ engaging the rail foot such that the shoulders $H_L$ and $H_S$ co-operate to define a spacing between them when their clips are clamped down, which corresponds to the width of the rail foot.

As will be apparent the clips may be rotated to bring selected shoulders 52 to bear or they may be inverted to bring other selected shoulders 52 to bear. Finally, the position of the clips relative to the rail 30 may be reversed from side to side so that the clip 5*a* is disposed for example on the right of the drawing, instead of on the left as shown.

In this way, a plurality of locations and dispositions of the two clips may be selected whereby the selected shoulders 52 of the two clips can be employed to clamp the rail 30 with the centre line of the rail foot being disposed in one of a selected number of alternative locations relative to the preformed holes 40 in the base plate 1, all according to the following table:

TABLE

| POSITION | CLIP | DISTANCE OF RAIL FOOT CENTRE LINE FROM CENTRE OF ONE OF HOLES 40 |
|---|---|---|
| 1 | $A^L$ $A^S$ | x + 7y |
| 2 | $B^L$ $B^S$ | x + 6y |
| 3 | $C^L$ $C^S$ | x + 5y |
| 4 | $D^L$ $D^S$ | x + 4y |
| 5 | $E^L$ $E^S$ | x + 3y |
| 6 | $F^L$ $F^S$ | x + 2y |
| 7 | $G^L$ $G^S$ | x + y |
| 8 | $H^L$ $H^S$ | x |
| | $H^S$ $H^L$ | x |
| 9 | $G^S$ $G^L$ | x − y |
| 10 | $F^S$ $F^L$ | x − 2y |
| 11 | $E^S$ $E^L$ | x − 3y |
| 12 | $D^S$ $D^L$ | x − 4y |
| 13 | $C^S$ $C^L$ | x − 5y |
| 14 | $B^S$ $B^L$ | x − 6y |
| 15 | $A^S$ $A^L$ | x − 7y |

In the above table, A to H represent identifying letters which may appear on the shoulders 52; L indicates 'long', and S indicates 'short'. Hence, for example, and as shown, when the shoulders identified as $H^L$ and $H^S$ engage the rail, its foot will have its centre line spaced equally from the two base plate holes 40 by a distance *x*. By altering the disposition of the clips this centre line can be adjusted by increments of distance *y* towards or away from one of the holes 40 giving a total of fifteen possible alternative locations of the centre line of the rail foot relative to the base plate holes 40.

If instead of as shown in the illustrated embodiment, the clips on each side of the rail are identical, the number of different locations to which the rail may be adjusted will obviously be substantially fewer than with the arrangement illustrated wherein the clip 5*a* is substantially larger than the clip 5*b*.

The rail clips 5*a* and 5*b* are preferably manufactured of steel forgings which represent a simple method of manufacture in which their accuracy and strength, including resistance to shock, are all safeguarded, and in summary, the invention provides a rail fastening arrangement which is relatively economical and yet which permits a flat bottom rail to be located accurately in a large number of selected alternative locations relative to holes preformed in a fixed foundation.

I claim:

1. A rail fastening arrangement for securing a flat bottom rail on a foundation having preformed holes therein comprising in combination:

a. a base plate having a top face on which the flat bottom of the rail is adapted to rest and means for securing the base plate to the preformed holes in the foundation;

b. a pair of rail clips one on each side of the rail and each having a topmost surface and a bottom surface;

c. bolt anchorage means for fastening the clips to the base plate passing through a bolt aperture in each clip, the bolt anchorage means having a threaded shank portion engaged in a preformed bolt hole in the base plate and a head extending above the topmost surface of the clip to be easily accessible for tightening the bolt anchorage means;

d. the topmost and bottom surfaces of each clip having defined therein at least two recesses which are symmetrically spaced about the bolt aperture, the base plate having two pins upstanding from the top face thereof, each of said pins being located on each side of the rail foot, each pin being received and located in one of the clip recesses;

e. said recesses being located on said clips such that the bottom surface of each clip is engageable with the base plate top face with the clip recesses receiving the base plate pins so that said clip is engageable with the base plate in at least two alternative dispositions;

f. a rail foot abutting and clamping shoulder on each clip corresponding to each recess, one of which rail foot abutting and clamping shoulders faces inwardly towards the rail foot for each alternative disposition of the clip with respect to the base plate;

g. and each rail foot abutting and clamping shoulder being spaced from the center of each clip a predetermined distance, with the predetermined distances each being different.

2. A rail fastening according to claim 1, wherein each clip has upper and lower oppositely facing sides, there being on each of said sides at least two recesses symmetrically spaced about the bolt aperture of the clip, and for each recess a respective rail foot abutting and clamping shoulder, each respective such shoulder being differentially spaced from the centre of the bolt aperture of the clip.

3. A rail fastening as claimed in claim 1, wherein the two rail clips one on each side of the rail are identical with one another.

4. A rail fastening according to claim 2, wherein each clip has on each side of its upper and lower oppositely facing sides four recesses symmetrically spaced about the bolt aperture of the clip, and for each recess a respective rail foot abutting and clamping shoulder, with all sixteen of the rail foot abutting and clamping shoulders of the two complementary clips, one on each side of the rail, being differentially spaced from the bolt aperture of the respective clips.

5. A rail fastening arrangement according to claim 1, wherein the pair of clips, one on each side of the rail, each have at least three respective rail foot abutting and clamping shoulders and a corresponding number of recesses, with all said respective rail foot abutting and clamping shoulders of each clip being differentially spaced from the bolt aperture centres of the clip, and wherein the pair of clips, while being different from one another, are interchangeable, one with the other.

6. A rail fastening arrangement according to claim 1, wherein the same bolt means which are employed to secure the clips to the base plate, are also employed to secure the base plate to the foundation, the base plate having only two through holes preformed therein, said holes registering with two preformed holes in the foundation.

7. A rail fastening according to claim 1, wherein the heads of the pins upstanding from the base plate are spherically domed in conformity with the shape of the clip recesses which are spherical re-entrant.

8. A rail fastening according to claim 1, wherein the pins are each located to upstand from the base plate on the side of the bolt hole remote from the rail foot, the two pins and two bolt holes being aligned.

9. A rail fastening according to claim 1, wherein the pins are secured in preformed holes in the base plate by rivetting.

10. A rail fastening arrangement according to claim 5, wherein the metal base plate has noncircular through holes located to register with the preformed holes of the foundation and wherein the bolt means securing the base plate to the foundation pass through the holes in registry, with each foundation bolt means comprising a bolt passing through the base plate to engage a nut member located in one of the foundation holes, the nut member having an elongate shank terminating at its end remote from the bolt in an enlarged head, said head and said shank being encased by a sleeve of elastomeric material and wherein on said bolt being tightened, said nut is moved axially, with said elastomeric sleeve being compressed between the enlarged head of the nut and the base plate, so that said sleeve is deformed into engagement with the wall of the foundation hole, and further, wherein said nut member has its end adjacent the base plate so shaped that it can enter and key with one of the non-circular holes of the base plate, whereby said nut is prevented from rotation relative to the base plate.

11. A rail fastening according to claim 1 wherein the pins are secured in preformed holes in the base plate by welding.

12. A rail fastening according to claim 1 wherein the pins are secured in preformed holes in the base plate by adhesive bonding.

13. A rail fastening according to claim 1 wherein the pins are secured in preformed holes in the base plate by press fitting.

14. A rail fastening according to claim 1 wherein the pins are secured in preformed holes in the base plate by taper fitting.

* * * * *